US009024504B2

(12) United States Patent
Nishio et al.

(10) Patent No.: US 9,024,504 B2
(45) Date of Patent: May 5, 2015

(54) CARBON COMMUTATOR AND A METHOD FOR PRODUCTION THEREOF

(75) Inventors: Makoto Nishio, Mie (JP); Shinya Nakagawa, Mie (JP); Yuya Nishino, Mie (JP); Kenzo Kiyose, Aichi (JP); Takashi Fukutsuka, Aichi (JP)

(73) Assignees: Denso Corporation, Kariya (JP); Tris Inc., Matsusaka (JP)

( * ) Notice: Subject to any disclaimer, the term of this patent is extended or adjusted under 35 U.S.C. 154(b) by 473 days.

(21) Appl. No.: 13/358,920

(22) Filed: Jan. 26, 2012

(65) Prior Publication Data

US 2012/0194029 A1 Aug. 2, 2012

(30) Foreign Application Priority Data

Jan. 31, 2011 (JP) ..... 2011-017781
Dec. 22, 2011 (JP) ..... 2011-280645

(51) Int. Cl.
*H01R 39/04* (2006.01)
*H01R 43/06* (2006.01)

(52) U.S. Cl.
CPC ..... *H01R 39/045* (2013.01); *H01R 43/06* (2013.01)

(58) Field of Classification Search
CPC ..... H01R 39/04; H01R 39/045
USPC ..... 310/233, 237
See application file for complete search history.

(56) References Cited

U.S. PATENT DOCUMENTS

| | | | | |
|---|---|---|---|---|
| 4,484,389 | A | 11/1984 | Kogej et al. | |
| 4,667,394 | A | 5/1987 | Bode et al. | |
| 4,698,902 | A | 10/1987 | Bode et al. | |
| 5,447,681 | A * | 9/1995 | Tai Seung et al. | 419/36 |
| 5,629,576 | A * | 5/1997 | Shimoyama | 310/237 |
| 5,912,523 | A * | 6/1999 | Ziegler et al. | 310/237 |
| 5,933,939 | A | 8/1999 | Nomerange et al. | |
| 6,222,298 | B1 * | 4/2001 | Saito et al. | 310/233 |
| 6,242,839 | B1 | 6/2001 | Cefo | |
| 6,674,212 | B2 * | 1/2004 | Inukai et al. | 310/223 |
| 6,833,650 | B2 * | 12/2004 | Hara et al. | 310/233 |
| 2010/0141081 | A1 * | 6/2010 | Maeda et al. | 310/220 |

FOREIGN PATENT DOCUMENTS

| | | | |
|---|---|---|---|
| DE | 10224738 | A1 | 6/2003 |
| DE | 102008004378 | A1 | 7/2009 |
| JP | 20020369454 | | 2/2004 |
| WO | 9908367 | | 2/1999 |

OTHER PUBLICATIONS

Barr, H.N., "The Application Of Electric Motors in Vehicles", Proceedings of Institution of Mechanical Engineers (Proc Instin Mech Engrs) 1969-1970, vol. 184 Pt 3A, pp. 103-106.

* cited by examiner

*Primary Examiner* — Burton Mullins
(74) *Attorney, Agent, or Firm* — The Webb Law Firm

(57) ABSTRACT

A segment of a carbon commutator includes a carbon layer on a surface side and a metallic carbon layer on a bottom side, and the carbon layer and the metallic carbon layer both contain a thermoplastic resin binder.

6 Claims, 3 Drawing Sheets

CARBON COMMUTATOR AND A METHOD FOR PRODUCTION THEREOF

BACKGROUND OF THE INVENTION

1. Field of the Invention

The present invention relates to a carbon commutator including a carbon layer and a metallic carbon layer, and a method for production thereof.

2. Description of Related Art

Carbon commutators are used in fuel pump motors and the like, and carbon segments come into contact with a brush, the segments being fixed to a riser piece as a metal terminal. Such carbon commutators have a problem in that the metal components contained in the segments are corroded by alcohol, sulfide and the like included in fuel. In this regard, Patent Document 1 (JP 2002-369454A) discloses a carbon commutator in which the segment is composed of two layers, namely, a carbon layer on a surface side and a metallic carbon layer on a riser piece side so as to isolate the metallic carbon layer from alcohol and the like. The metallic carbon layer is provided with protrusions, and the protrusions are press-fitted into holes of the riser piece so as to fix the segments, thereby eliminating the need for soldering and the like. For the metallic carbon layer, instead of copper, brass is used in order to prevent corrosion of metal, and tin is mixed therewith to cause liquid phase sintering. Furthermore, phenol resin is used as a binder in both the carbon layer and the metallic carbon layer.

Patent Document 2 (WO 99/08367) also discloses a carbon commutator including two layers, namely a carbon layer and a metallic carbon layer. The metallic carbon layer is formed by baking at 800 to 850° C. using electrolytic copper powder, tin powder and carbon with phenol resin as a binder. Due to the tin powder being melt, liquid phase sintering occurs, and the carbon in the carbon layer and the metallic carbon layer are sintered with the binder.

The carbon commutators of Patent Documents 1 and 2 use phenol resin as a binder, and therefore baking is performed at a temperature greater than or equal to 700° C. at which the phenol resin is carbonized to function as a binder. However, superior sliding characteristics may be obtained with a carbon layer baked at a lower temperature. The present inventors have found that when a metallic carbon layer using phenol resin as a binder is baked at a low temperature, the metallic carbon layer will have completely insufficient strength. Based on the founding, the present inventors have found a composition for a metallic carbon layer that can be baked at a low temperature and a method for producing a carbon commutator, and the present invention has thus been accomplished.

SUMMARY OF THE INVENTION

It is an object of the present invention to provide a carbon commutator using a metallic carbon layer that can be obtained by low temperature baking (sintering) and has sufficient electrical characteristics and mechanical characteristics, and a method for production thereof.

The present invention relates to a carbon commutator including a segment including a carbon layer on a surface side and a metallic carbon layer on a bottom side, the metallic carbon layer of the segment being fixed to a riser piece, wherein the carbon layer and the metallic carbon layer both contain a thermoplastic resin binder. The thermoplastic resin binder melts or softens to serve as a binder in each layer and bond the carbon layer and the metallic carbon layer. Accordingly, a carbon commutator having practical strength and conductivity can be obtained by low temperature baking.

Preferably, the metallic carbon layer contains copper powder, for example, electrolytic copper powder. The electrolytic copper powder has a dendritic shape, and thus is entangled with other particles, thereby imparting strength and conductivity to the metallic carbon layer as well as forming snags, or irregularities, at the interface between the carbon layer and the metallic carbon layer. Particularly preferably, the metallic carbon layer further contains tin. Also, preferably, the metallic carbon layer contains copper alloy powder such as brass powder, bronze powder or copper-nickel alloy powder. Particularly preferably, the metallic carbon layer contains brass powder with a zinc content of, for example, 10 to 40 mass %. Copper powder may suffer corrosion due to sulfur and the like included in liquid fuel, but copper alloy powder such as brass powder has high corrosion resistance to sulfur and the like. Particularly preferably, the metallic carbon layer further contains tin. More preferably, the metallic carbon layer contains electrolytic copper powder and brass powder. The electrolytic copper powder provides conductivity and strength to the metallic carbon layer as well as adhesion strength to the carbon layer, and the brass powder provides corrosion resistance to sulfur and the like included in liquid fuel. Particularly preferably, the metallic carbon layer further contains tin.

With tin in the metallic carbon layer, liquid phase sintering of tin having a melting point of about 230° C. is utilized in sintering of the metallic carbon layer. Because sintering is performed at the melting point of tin or greater, it is preferable that the thermoplastic resin binder has a melting point of 230° C. to 400° C., and for example, PPS (polyphenylene sulfide), PEEK (polyether ether ketone), 66 nylon, polytetrafluoroethylene or the like is used. In the case where tin is not used, a polyethylene having a melting point of around 120° C. can be used as a binder. The electrolytic copper powder and other metal powders such as the brass powder do not melt at 230 to 400° C. and thus remain as powder in the metallic carbon layer, and are bonded to each other by tin and the thermoplastic resin binder. In this specification, when a range is indicated using "to" such as 230 to 400° C., or 5 to 40 mass %, it is understood that the range includes a lower limit and an upper limit such as 230° C. or greater and 400° C. or less, or 5 mass % or greater and 40 mass % or less.

Regarding the composition, it is preferable that the metallic carbon layer contains 5 to 40 mass % of electrolytic copper powder, 2 to 30 mass % of tin and 20 to 83 mass % of brass powder, with a total of 90 mass % or more of the metal components, and further contains 0.3 to 4 mass % of thermoplastic resin binder and the remaining mass % of carbon. Metallic carbon layers obtained by low temperature sintering have low conductivity. Accordingly, a metallic carbon layer is used, to ensure conductivity, that contains 5 to 40 mass % of electrolytic copper powder, 2 to 30 mass % of tin powder and 20 to 83 mass % of brass powder, with a total of 90 mass % or more of the metal component. Also, liquid phase sintering by tin, entanglement by the electrolytic copper powder, and strength as a result of the thermoplastic resin binder being melt or softened are ensured. The amount of the thermoplastic resin binder is preferably 0.3 to 4 mass %. Further preferably, the metallic carbon layer contains a total of 90 mass % or more of metal components such as the brass powder and tin and 0.3 to 4 mass % of thermoplastic resin binder with the remaining mass % of carbon. The carbon layer contains a thermoplastic resin binder of the same chemical formula as that of the metallic carbon layer in an amount of 3 to 15 mass % and the remaining mass % of carbon.

It is preferable that the carbon layer contains a thermoplastic resin binder of the same chemical formula as that of the metallic carbon layer in an amount of 3 to 15 mass % and the remaining mass % of carbon. Particularly when the metallic carbon layer and the carbon layer have the same mass ratio between carbon and thermoplastic resin, and contain thermoplastic resin binders of the same chemical formula, the same level of bonding of carbon particles can be obtained in the metallic carbon layer and the carbon layer. As used herein, "the same chemical formula" means having, in the case of poly(phenylene sulfide) (PPS) for example, the same chemical formula: -[ø-S]—$_n$, where ø is a phenylene group.

The present invention also relates to a method for production of a carbon commutator including a segment including a carbon layer on a surface side and a metallic carbon layer on a bottom side, the metallic carbon layer of the segment being fixed to a riser piece, wherein a compression-molded article made of two layer materials, namely, a metallic carbon layer material containing carbon, a thermoplastic resin binder and metal powder and a carbon layer material containing carbon and a thermoplastic resin binder is baked at a temperature from a melting point of the thermoplastic resin binder to 500° C.

Compression molding and baking may be performed in the same mold, or baking may be performed separately after the molded article has been removed from the mold. Since the baking temperature is low, any atmosphere can be used. In order to avoid thermal decomposition of the binder, the baking temperature is preferably set to no less than the melting point of the binder and no more than 400° C. In the compression molding, the riser piece may be set in a mold, and press-fitting and molding of the metallic carbon layer to the riser piece may be performed at the same time. In the working examples given below, compression molding, baking, press-fitting, and the like are performed separately.

Preferably, the metallic carbon layer material contains carbon, a thermoplastic resin binder, brass powder and electrolytic copper powder. More preferably, the metallic carbon layer material contains carbon, a thermoplastic resin binder, brass powder, electrolytic copper powder and tin powder, and the compression-molded article is baked at 230° C. to 500° C. Particularly preferably, the metallic carbon layer material contains 5 to 40 mass % of electrolytic copper powder, 2 to 30 mass % of tin powder and 20 to 83 mass % of brass powder, with a total of 90 mass % or more of the metal components, and further contains 0.3 to 4 mass % of thermoplastic resin binder and the remaining mass % of carbon. In this specification, the descriptions regarding the carbon commutator apply to the method for production of a carbon commutator.

According to the present invention, it is possible to obtain a carbon commutator using a metallic carbon layer that can be obtained by low temperature baking and has sufficient electrical characteristics and mechanical characteristics due to bonding by the thermoplastic resin binder. When the metallic carbon layer contains electrolytic copper powder, even higher strength is obtained. When the metallic carbon layer contains copper alloy powder such as brass powder, the corrosion resistance to sulfur and the like included in liquid fuel is improved. By inclusion of tin, increased strength can be obtained by liquid phase sintering of tin. The baking temperature can be adjusted by selection of the type of thermoplastic resin binder.

DETAILED DESCRIPTION OF THE PREFERRED EMBODIMENT

Figure 1:
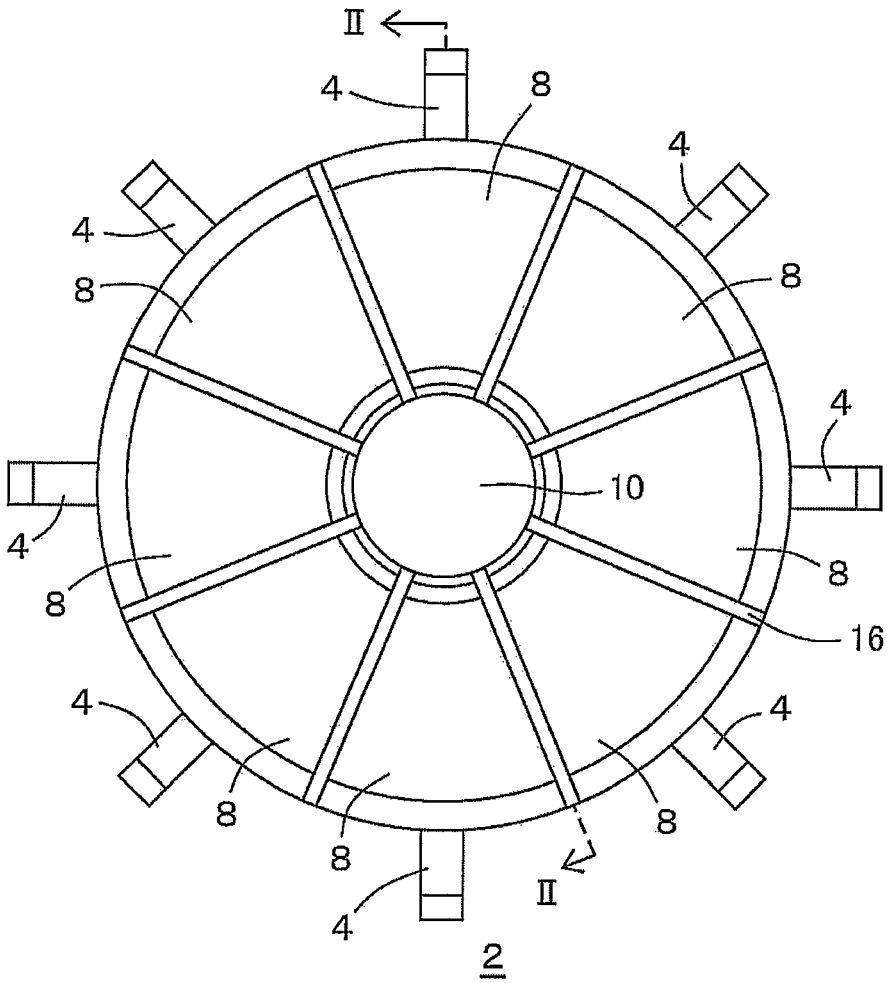
FIG. 1 is a plan view of a carbon commutator according to an embodiment of the present invention.
Figure 2:
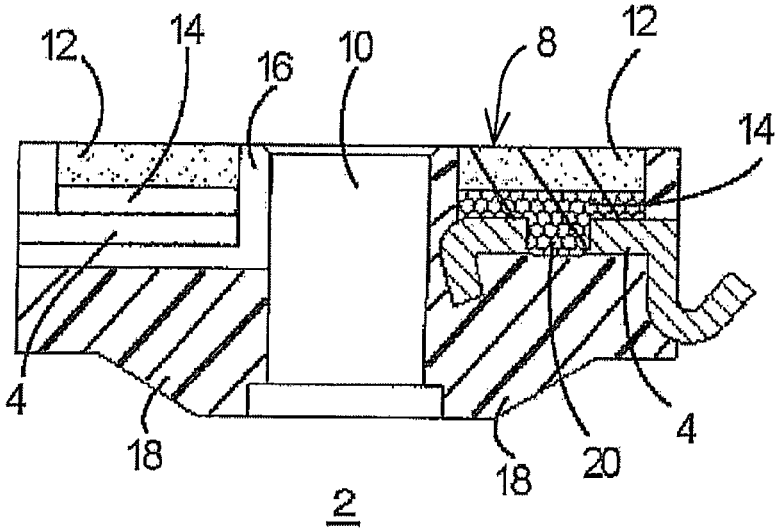
FIG. 2 is a cross-sectional view of the carbon commutator taken in the direction indicated by II-II of FIG. 1.
Figure 3:
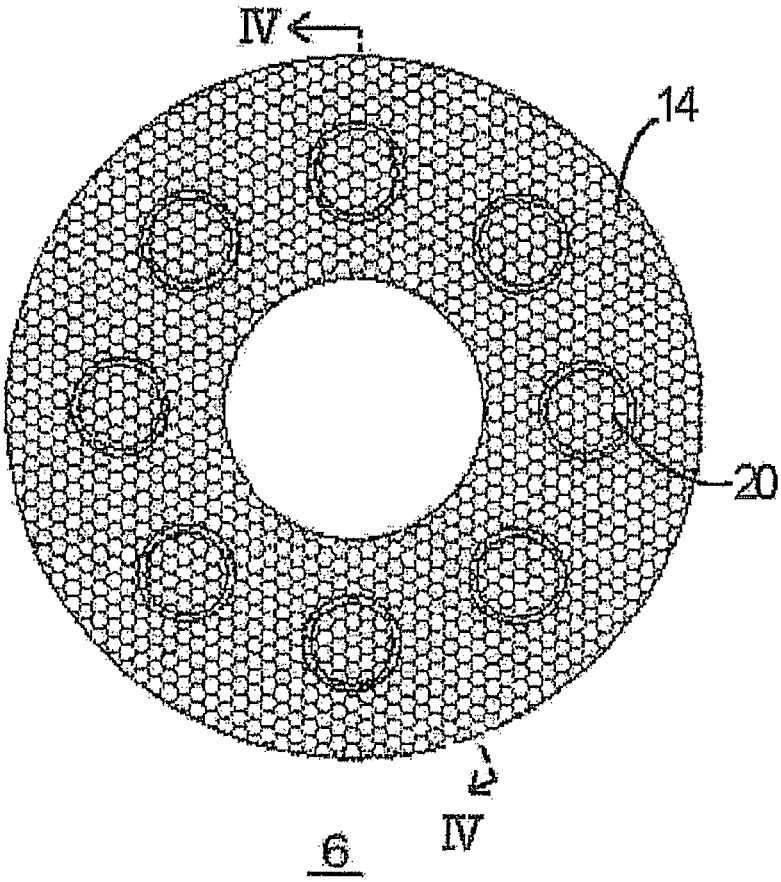
FIG. 3 is a bottom view of a carbon plate according the embodiment.
Figure 4:
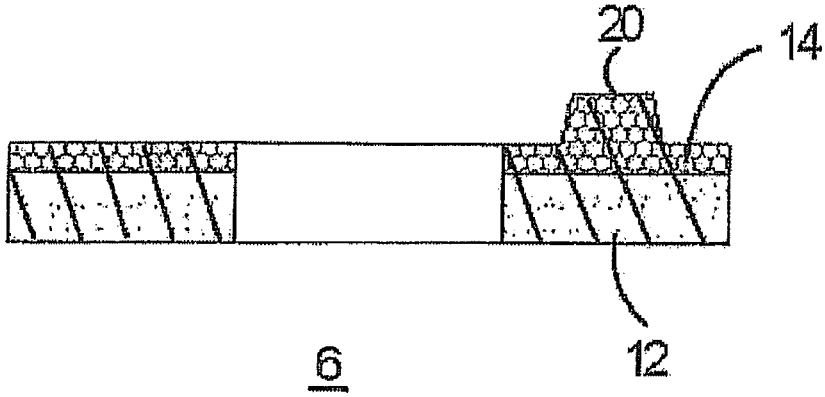
FIG. 4 is a cross-sectional view of the carbon plate taken in the direction indicated by IV-IV of FIG. 3.

Hereinafter, a preferred embodiment for carrying out the present invention will be described. The present invention is not limited to the embodiment described herein, and is defined based on the claims and can be modified by adding, to the embodiment, matter known to those skilled in the art.

FIGS. 1 to 7 show an embodiment and characteristics thereof. FIGS. 1 to 4 show a structure of a carbon commutator 2 in which segments 8 obtained by cutting a carbon plate 6 are fixed to metal riser pieces 4 by press-fitting or the like. Reference numeral 10 indicates a shaft hole. Each segment 8 is composed of two layers, namely, a carbon layer 12 on a surface side and a metallic carbon layer 14 press-fitted to the riser piece 4. The segments 8 are separated from each other by slits 16 which also separate the riser pieces 4 from each other. Reference numeral 18 indicates a resin portion that is molded so as to bury the riser piece 4. A protrusion 20 of the metallic carbon layer 14 is press-fitted into a hole of the riser piece 4. The carbon commutator 2 can have any structure.

WORKING EXAMPLES

Step 1

Brass powder (water-atomized powder containing 30 mass % of Zn with an average particle size of 40 μm) in an amount of 60 mass %, 20 mass % of electrolytic copper powder (an average particle size of 40 μm) and 10 mass % of tin powder were uniformly mixed, using a mixer, with 10 mass % of natural graphite (an average particle size of 30 μm) mixed powder that has been mixed in advance with 8 mass % of PPS (poly(phenylene sulfide)) resin powder (an average particle size of 15 μm) to give a blend powder for a metallic carbon layer (metallic carbon layer material). As used herein, the natural graphite mixed powder that has been mixed with 8 mass % of PPS resin powder refers to a mixed powder containing 8 mass % of PPS and 92 mass % of natural graphite. Instead of mixing PPS resin powder with natural graphite powder in advance, PPS powder and natural graphite powder may be mixed with metal powder. Furthermore, the type of carbon is not limited to natural graphite, and artificial graphite such as electrographite, amorphous carbon or the like can be used. The powders can have any average particle size. The metallic carbon layer material contains a metal component in an amount of at least 85 mass % or more and 95 mass % or less, preferably 90 mass % or more and 95 mass % or less, and the remaining mass % of graphite and thermoplastic resin such as PPS. The metal component contains 5 to 40 mass % of electrolytic copper powder, 2 to 30 mass % of tin powder, and 20 to 83 mass % of brass powder, with the total amount being 85 mass % or more, preferably 90 mass % or more and 95 mass % or less. The amount of the thermoplastic resin binder is preferably 0.3 to 4 mass %, and particularly preferably 0.3 to 1.5 mass %.

Step 2

The metallic carbon layer material obtained above was fed into a predetermined mold, and a separately blended carbon layer material for a slider member was fed thereon, which was then subjected to compression molding using an upper punch and a lower punch to give an unbaked carbon plate. It is preferable that the carbon layer material is composed of 92 mass % of natural graphite with an average particle size of 30 μm and 8 mass % of PPS, and the mass ratio of carbon to thermoplastic resin in the carbon layer material is equal to the mass ratio of carbon and thermoplastic resin binder in the metallic carbon layer material. The carbon layer material contains, for example, the same thermoplastic resin binder as that used in the metallic carbon layer in an amount of 3 to 15 mass %, and the remaining mass % of carbon such as natural graphite, artificial graphite or amorphous carbon. The metallic carbon layer and the carbon layer may contain different types of carbon. The metallic carbon layer may be composed of a relatively metal rich lower layer and a relatively carbon rich upper layer so that the composition varies smoothly at the interface between the metallic carbon layer and the carbon layer.

Step 3

The unbaked carbon plate was removed from the mold, and then heated and baked in, for example, air at 300° C., which is slightly higher than the melting point of PPS to give a carbon plate. In this process, the tin powder melts to bond the metal component particles to each other, and the PPS particles melt to bond the metallic carbon layer particles. At the same time, the carbon particles in the carbon layer are bonded to each other by PPS, and the interface between the metallic carbon layer and the carbon layer is also bonded. At the interface between the metallic carbon layer and the carbon layer, the electrolytic copper powder particles project to help these layers bond to each other. The baking temperature is set to the melting point of the thermoplastic resin or greater, preferably 230° C., which is close to the melting point of tin, or greater and 500° C. or less, and more preferably 230° C. or greater and 400° C. or less.

Step 4

The carbon plate was press-fitted into a riser piece before cutting into segments, and set in a mold, and a resin for a housing was injection molded. Next, the carbon plate and the riser piece were cut to form slits, and thereby a carbon commutator was obtained. The carbon commutator obtained in this manner will be referred to as Working Example 1.

A blend powder for a metallic carbon layer was prepared by uniformly mixing 80 mass % of the same brass powder used above, 10 mass % of the same tin powder and 10 mass % of the same mixed powder. The mixed powder was a mixed powder containing 8 mass % of PPS resin powder (an average particle size of 15 μm) and 92 mass % of natural graphite powder with an average particle size of 30 μm. As in Working Example 1, the mixed powder was also used as a carbon layer material. Then, as in Working Example 1, compression molding and baking in air at 300° C. were performed, and the resultant was press-fitted into a riser piece to give a carbon commutator, and this carbon commutator will be referred to as Working Example 2.

COMPARATIVE EXAMPLES

Step 1

A blend powder for a metallic carbon layer was obtained by uniformly mixing, using a mixer, 70 mass % of the same brass powder as that used above, 5 mass % of the same tin powder, and 25 mass % of natural graphite mixed powder (the graphite having an average particle size of 30 μm before being mixed) that has been mixed with 20 mass % of phenol resin.

Step 2

The blend powder for a metallic carbon layer was fed into a predetermined mold, and the same natural graphite mixed powder that has been mixed in advance with 20 mass % of phenol resin was fed thereon, which was then subjected to compression molding to give an unbaked carbon plate.

Step 3

The unbaked carbon plate was heated and baked in a reducing gas atmosphere at 900° C. or 300° C.

Step 4

Carbon commutators were obtained in the same manner as in the working examples by using the baked carbon plates. Hereinafter, the carbon commutator produced by baking at 300° C. will be referred to as Comparative Example 1, and the carbon commutator produced by baking at 900° C. will be referred to as Comparative Example 2.

Table 1 shows the conditions for production and the characteristics of Working Examples 1 and 2 and Comparative Examples 1 and 2. The interface tensile strength shown in Table 1 indicates the tensile strength at the interface between the metallic carbon layer and the carbon layer.

TABLE 1

| | Example 2 | Example 1 | Comparative Example 1 | Comparative Example 2 |
|---|---|---|---|---|
| Brass | 80 mass % | 60 mass % | 70 mass % | 70 mass % |
| Electrolytic copper powder | — | 20 mass % | — | — |
| Tin | 10 mass % | 10 mass % | 5 mass % | 5 mass % |
| Graphite (Binder) | 9.2 mass % PPS 0.8 mass % | 9.2 mass % PPS 0.8 mass % | 20 mass % Phenol 5 mass % | 20 mass % Phenol 5 mass % |
| Baking temperature | 300° C. | 300° C. | 300° C. | 900° C. |
| Metal layer specific resistance (μΩ · cm) | 1400 | 700 | 80000 | 200 |
| Metal layer flexural strength (MPa) | 16 | 28 | 5 | 18 |
| Interface tensile strength (MPa) | 4.0 | 4.4 | 3.2 | 1.8 |

Figure 5:
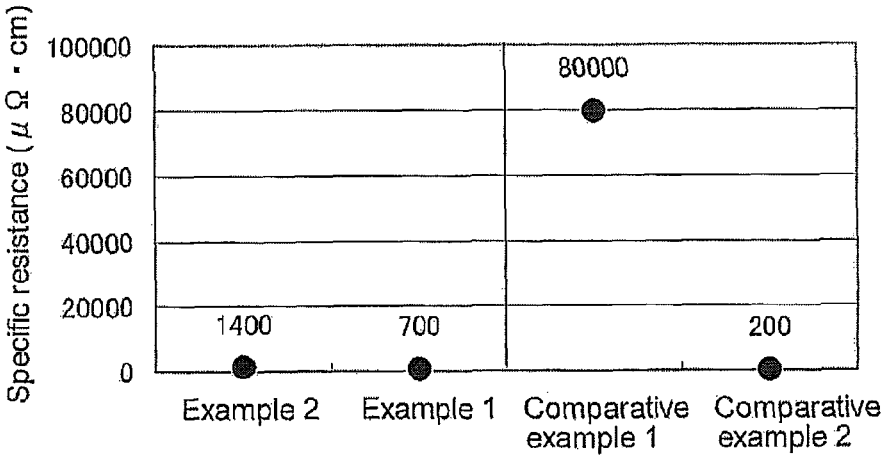
FIG. 5 is a characteristic diagram showing a relationship between baking temperature and specific resistance of metallic carbon layer in working examples and comparative examples.
Figure 6:
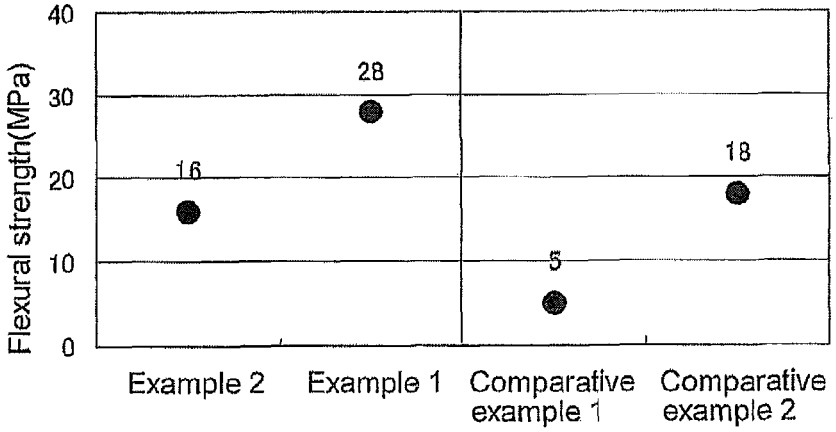
FIG. 6 is a characteristic diagram showing a relationship between baking temperature and flexural strength of metallic carbon layer in working examples and comparative examples.
Figure 7:
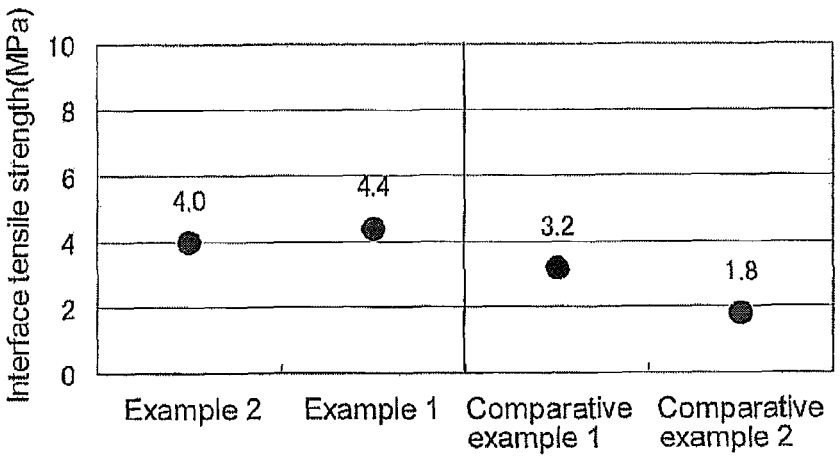
FIG. 7 is a characteristic diagram showing tensile strengths between metallic carbon layer and carbon layer in working examples and comparative examples.

The characteristics of the working examples and the comparative examples are shown in Table 1 and FIGS. 5 to 7. FIG. 5 shows the specific resistance of the metallic carbon layer, and FIG. 6 shows the flexural strength of the metallic carbon layer. FIG. 7 shows the interface tensile strength. When a metallic carbon layer material having phenol resin binder content of 5 mass % of and a metal component content of 75 mass % was baked at 300° C. (Comparative Example 1), a specific resistance of 80000 μΩ·cm was obtained, which is 400 times greater than that of Comparative Example 2 produced by baking at 900° C., and a flexural strength of 5 MPa was obtained, which is less than one third of that of Comparative Example 2 produced by baking at 900° C. From the above, it was found that low temperature baking such as at 300° C. using a phenol resin binder does not produce a practical carbon commutator.

Comparison between Working Examples 1 and 2 produced by baking at 300° C. (using 0.8 mass % of PPS binder) and Comparative Example 2 produced by baking at 900° C. (using 5 mass % of phenol resin binder) shows that in the working examples, the specific resistance was higher than that of Comparative Example 2, the flexural strength was approximately equal to or greater than that of Comparative Example 2, and the tensile strength of the interface between the metallic carbon layer and the carbon layer was higher than that of Comparative Example 2. From this, it can be seen that the working examples provided overall equivalent performance to Comparative Example 2 having a binder content of 5 mass % and produced by baking at 900° C., despite the fact that the working examples had a lower binder content of 0.8 mass % and were produced by low temperature baking at 300° C.

The above effects were attained by the fact that both the carbon layer and the metallic carbon layer contained a thermoplastic resin binder, that the thermoplastic resin binder and liquid phase sintering of tin were used in combination, and that the metal content of the metallic carbon layer was increased to 90 mass %. Inclusion of electrolytic copper powder in the metallic carbon layer resulted in reduced metal layer specific resistance and improved metal layer flexural strength and interface tensile strength, but even Working Example 2 including no electrolytic copper powder provided practical performance.

What is claimed is:

1. A carbon commutator comprising a plurality of segments including a carbon layer on a surface side of the segments and a metallic carbon layer on a bottom side of the segments, the metallic carbon layer of the segments being fixed to a riser piece, wherein the carbon layer and the metallic carbon layer both contain at least a thermoplastic resin binder and wherein the metallic carbon layer contains electrolytic copper powder which remains in powder form after the metallic carbon layer has been fixed to the riser piece, wherein the metallic carbon layer contains electrolytic copper powder, brass powder, and tin, wherein the thermoplastic resin binder has a melting point of 230° C. to 400° C., and wherein the metallic carbon layer contains 5 to 40 mass % of electrolytic copper powder, 2 to 30 mass % of tin and 20 to 83 mass % of brass powder, with a total of 90 mass % or more of metal components, and further contains 0.3 to 4 mass % of thermoplastic resin binder and the remaining mass % of carbon.

2. The carbon commutator according to claim 1, wherein the metallic carbon layer contains copper alloy powder.

3. The carbon commutator according to claim 2, wherein the copper alloy powder is brass powder.

4. The carbon commutator according to claim 1, wherein the carbon layer contains a thermoplastic resin binder of the same chemical formula as that of the metallic carbon layer in an amount of 3 to 15 mass % and the remaining mass % of carbon.

5. A method for production of a carbon commutator comprising a plurality of segments including a carbon layer on a surface side of the segments and a metallic carbon layer on a bottom side of the segments, the metallic carbon layer of the segments being fixed to a riser piece, wherein a compression-molded article made of two layer materials, comprising a metallic carbon layer material containing carbon, a thermoplastic resin binder and metal powder, and a carbon layer material containing carbon and a thermoplastic resin binder is baked at a temperature from 230° C. to 400° C. and wherein the metallic carbon layer contains electrolytic copper powder which remains in powder form after the metallic carbon layer has been fixed to the riser piece, wherein the metallic carbon layer material contains carbon, a thermoplastic resin binder, brass powder, electrolytic copper powder, and tin powder, and wherein the metallic carbon layer material contains 5 to 40 mass % of electrolytic copper powder, 2 to 30 mass % of tin powder and 20 to 83 mass % of brass powder, with a total of 90 mass % or more of metal components, and further contains 0.3 to 4 mass % of thermoplastic resin binder and the remaining mass % of carbon.

6. A carbon commutator comprising a plurality of segments including a carbon layer on a surface side of the segments and a metallic carbon layer on a bottom side of the segments, the metallic carbon layer of the segments being fixed to a riser piece, wherein the carbon layer and the metallic carbon layer both contain at least a thermoplastic resin binder having a melting point of 230° C. to 400° C., wherein the metallic carbon layer contains copper alloy powder and tin, and wherein the metallic carbon layer contains a total of 90 mass % or more of metal components and 0.3 to 4 mass % of thermoplastic resin binder with the remaining mass % of carbon and the carbon layer further contains a thermoplastic resin binder of the same chemical formula as that of the metallic carbon layer in an amount of 3 to 15 mass % and the remaining mass % of carbon.

* * * * *